US009260812B2

(12) United States Patent
Moon et al.

(10) Patent No.: US 9,260,812 B2
(45) Date of Patent: Feb. 16, 2016

(54) LAUNDRY MACHINE

(75) Inventors: Suk Yun Moon, Changwon-si (KR); Min Gyu Jo, Changwon-si (KR); Ig Geun Kwon, Changwon-si (KR); Soo Bong Kim, Changwon-si (KR); Dong Il Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1043 days.

(21) Appl. No.: 13/143,002

(22) PCT Filed: Dec. 30, 2009

(86) PCT No.: PCT/KR2009/007938

§ 371 (c)(1),
(2), (4) Date: Aug. 5, 2011

(87) PCT Pub. No.: WO2010/077083

PCT Pub. Date: Jul. 8, 2010

(65) Prior Publication Data

US 2011/0285260 A1 Nov. 24, 2011

(30) Foreign Application Priority Data

| | | |
|---|---|---|
| Dec. 30, 2008 | (KR) | 10-2008-0136408 |
| May 28, 2009 | (KR) | 10-2009-0047192 |
| Aug. 27, 2009 | (KR) | 10-2009-0079949 |
| Dec. 28, 2009 | (KR) | 10-2009-0131646 |
| Dec. 28, 2009 | (KR) | 10-2009-0131647 |

(51) Int. Cl.
*D06F 37/26* (2006.01)
*D06F 37/22* (2006.01)
(Continued)

(52) U.S. Cl.
CPC ..... *D06F 37/266* (2013.01); *D06F 25/00* (2013.01); *D06F 37/20* (2013.01); *D06F 37/22* (2013.01); *D06F 37/263* (2013.01); *D06F 37/264* (2013.01); *D06F 37/268* (2013.01); *D06F 37/269* (2013.01)

(58) Field of Classification Search
CPC ..... D06F 37/266; D06F 37/263; D06F 37/20; D06F 37/22; D06F 37/269
USPC ..... 68/24, 58, 139, 140
See application file for complete search history.

(56) References Cited

U.S. PATENT DOCUMENTS

| | | | | |
|---|---|---|---|---|
| 3,022,656 | A | 2/1962 | Bergeson et al. | 68/207 |
| 3,038,639 | A | 6/1962 | Andersen | 222/70 |
| 6,256,823 | B1 * | 7/2001 | Kronbetter et al. | 8/158 |

(Continued)

FOREIGN PATENT DOCUMENTS

| | | |
|---|---|---|
| DE | 297 16 968 U1 | 11/1997 |
| DE | 198 56 973 A1 | 6/1999 |

(Continued)

OTHER PUBLICATIONS

Russian Decision to Grant a Patent dated Aug. 29, 2013 issued in Application No. 2011132061 (with English translation).

(Continued)

*Primary Examiner* — Joseph L Perrin
(74) *Attorney, Agent, or Firm* — Ked & Associates LLP

(57) ABSTRACT

A laundry machine for treating laundry is disclosed. The laundry machine includes a front gasket having a structure capable of effectively preventing leakage of wash water or effectively preventing laundry or foreign matter from being introduced between a tub and a drum.

16 Claims, 14 Drawing Sheets

(51) Int. Cl.
*D06F 37/20* (2006.01)
*D06F 25/00* (2006.01)

(56) References Cited

U.S. PATENT DOCUMENTS

| | | | | |
|---|---|---|---|---|
| 7,251,963 | B2 * | 8/2007 | Kim et al. | 68/196 |
| 7,398,662 | B2 * | 7/2008 | Kim et al. | 68/23 A |
| 2004/0107742 | A1 * | 6/2004 | Kim et al. | 68/24 |
| 2004/0163426 | A1 | 8/2004 | Kim et al. | 68/23 |
| 2005/0178169 | A1 * | 8/2005 | Kim et al. | 68/23.1 |
| 2006/0150687 | A1 * | 7/2006 | Chang et al. | 68/24 |
| 2006/0169006 | A1 * | 8/2006 | Lim et al. | 68/13 R |
| 2008/0264114 | A1 * | 10/2008 | Jang et al. | 68/139 |
| 2008/0307833 | A1 * | 12/2008 | Chang et al. | 68/23.1 |

FOREIGN PATENT DOCUMENTS

| | | | |
|---|---|---|---|
| DE | 20 2004 012 221 | U1 | 9/2004 |
| DE | 103 59 011 | B3 | 5/2005 |
| EP | 0 655 523 | A1 | 5/1995 |
| EP | 1 433 890 | A2 | 6/2004 |
| EP | 1 433 891 | A2 | 6/2004 |
| EP | 1 445 368 | A2 | 8/2004 |
| EP | 1 605 088 | A2 | 12/2005 |
| FR | 2 215 503 | A1 | 8/1974 |
| GB | 2 029 862 | A | 3/1980 |
| KR | 10-0240120 | B1 | 1/2000 |
| KR | 10-2004-0047192 | A | 6/2004 |
| KR | 10-2005-0117004 | A | 12/2005 |
| RU | 2002134470 | A | 5/2004 |
| RU | 2008108825 | A | 9/2009 |
| RU | 2 413 043 | C2 | 2/2011 |
| WO | WO 2007/017726 | A1 | 2/2007 |
| WO | EP 2 391 760 | | 7/2010 |

OTHER PUBLICATIONS

European Search Report dated Jul. 31, 2012 issued in Application No. 09 83 6404.
PCT International Search Report dated Sep. 13, 2010 issued in Application No. PCT/KR2009/007938.
Mexican Office Action dated Jun. 30, 2015.

* cited by examiner

LAUNDRY MACHINE

TECHNICAL FIELD

The present invention relates to a laundry machine for treating laundry.

BACKGROUND ART

As typical laundry machines, there are a washing machine and a drying machine. In particular, the washing machine generally includes a pulsator-type washing machine and a drum washing machine. Of such washing machines, there is a washing machine having a drying function, which can perform not only a washing operation, but also a drying operation.

In a drum washing machine, a tub is horizontally arranged. In the tub, a drum is also horizontally arranged. Laundry, which is contained in the drum, is tumbled as the drum rotates. As a result, the laundry is washed.

The tub functions to contain wash water. The drum contains laundry to be washed.

The drum is rotatably installed in the tub.

A rotating shaft is connected to a rear wall of the drum. The rotating shaft receives a rotating force from a motor. The rotating force, which is generated in accordance with rotation of the motor, is transmitted to the drum via the rotating shaft, thereby rotating the drum.

The drum rotates not only in a washing operation, but also in rinsing and spin-drying operations. During such rotation, the drum is vibrated.

The rotating shaft extends through the rear wall of the tub such that it is protruded outwardly of the tub. The rotating shaft is rotatably supported by a bearing housing. The bearing housing is rigidly connected to the rear wall of the tub. For this reason, the vibration of the drum is directly transmitted to the tub.

In order to damp the above-mentioned vibration, a suspension unit is provided. Generally, the suspension unit is connected to the tub, to damp the vibration of the tub. Thus, the vibration generated during the rotation of the drum is transmitted to the tub, and is damped by the suspension unit.

DISCLOSURE OF INVENTION

Technical Problem

The tub has an opening to allow laundry to be loaded into or unloaded from the tub. A flexible member may be installed at a front wall of the tub where the opening is provided, in order to prevent wash water from being outwardly discharged through the opening, to prevent laundry or foreign matter from being caught between the tub and the drum, and to achieve other functions. An object of the present invention is to provide a laundry machine having a flexible member having a novel structure different from conventional flexible members.

Solution to Problem

In an embodiment of a laundry machine according to the present invention, a flexible member may be mounted to a tub. The flexible member may function to prevent wash water from being outwardly leaked through a laundry loading/unloading opening of the tub or to prevent laundry or foreign matter from being introduced between the tub and a drum.

The flexible member may be installed in a non-bonding manner.

For example, the flexible material may be hooked to an inner surface of the tub. The hooking may be achieved by a protrusion formed at one of an inside of the tub or the flexible member and a groove formed at the other one of the tub inside and the flexible member such that the protrusion is engaged in the groove.

The flexible member may be made of a material used to form a gasket. Hereinafter, the flexible member is referred to as a front gasket.

The laundry machine may include a door for opening or closing the laundry loading/unloading opening of the tub. The front gasket may be installed to come into contact with the door, in order to provide a sealing effect. The door may include a portion, which is made of a transparent material and is protruded rearwardly. In a conventional washing machine, such a transparent portion is generally made of glass, and is referred to as a door glass. In the following description, door glass is not limited to a product made of a glass material, and may include a product made of a transparent material other than glass.

A portion of the door glass may extend into the tub through the laundry loading/unloading opening of the tub. In this case, a portion of the door glass corresponding to ⅔ of the front-to-rear length of the door glass may extend into the tub. The door glass may be formed to have a vertical cross-section gradually reduced as the door glass extends rearwardly. In accordance with this structure, it may be possible to prevent the door glass from interfering with the drum.

The front gasket may be configured to provide a sealing effect between the laundry loading/unloading opening of the tub and the door. A portion of the front gasket, at which the sealing effect is provided, is referred to as a door sealing portion.

The tub has a front wall having a substantially plate shape. The laundry loading/unloading opening may be formed through the front wall. The tub may include a front extension, which extends forwardly from the front wall, for the formation of the laundry loading/unloading opening.

The front gasket may include a first coupler to be coupled to the front extension, a door sealing portion to seal the door, and a second coupler to be coupled to an inside of the tub. The second coupler may be arranged at a rear side of the first coupler. The first coupler may be mounted to the tub outside the tub. The second coupler may be mounted to the tub inside the tub.

A groove or protrusion may be formed at the inside of the tub. The second coupler may be formed to be coupled with the groove or protrusion. For example, a protrusion may be formed at the inside of the tub, and a groove may be formed at the second coupler such that the protrusion is engaged in the groove.

Meanwhile, the drum may include a front end axially spaced from an inner surface of the front wall of the tub. The front gasket may include a foreign matter cutoff member or a foreign matter catch preventing member for preventing foreign matter or laundry from being caught in the axial spacing.

The foreign matter cutoff member may be arranged at the axial spacing.

For example, the front gasket may have a portion extending rearwardly to cover the axial spacing. The extension portion may be formed in plural such that the plural extension portions are arranged in a radial direction. The extension portions may have a rib shape.

In the laundry machine, the tub may be fixedly supported, or be supported by a flexible support structure, such as the suspension unit.

Further, the tub may be supported in an interim state between the fixed support and the flexible support.

That is, the tub may be flexibly supported by the suspension unit or be rigidly supported. For example, the tub may be supported by the suspensions, be supported by rubber bushings to provide less flexible movement than when supported by the suspensions, or be fixedly supported by being fixed somewhere by screws or so.

For another instance, the cases where the tub is supported more rigidly than when supported by the suspension unit are as follows.

Firstly, the tub may be made intergrally with the cabinet.

Next, the tub may be supported by being fastened by screws, ribets, rubber bushings, etc. Also, the tub may be welded or bonded to the cabinet. In this cases, the supporting or fastening members have larger stiffnesses than a stiffness of the suspension unit with respect to the main direction of the vibration of the drum.

The tub may be expanded within the limits of a space in which the tub is placed. That is, the tub may be expanded until the circumferential surface thereof reaches(or almost reaches) a side wall or a side frame (for example, a left or right plate of a cabinet) restricting the size of the space at least in the lateral direction (the direction laterally perpendicular to the axial direction of the rotary shaft when the rotary shaft is horizontally placed). The tub may be made intergally with the lateral side walls of the cabinet.

The tub may be formed to be closer in the lateral direction to the wall or the frame than the drum. For example, the tub may be spaced away from the wall or the frame by an interval of less than 1.5 times an interval with the drum. Under the condition that the tub is enlarged in the lateral direction, the drum may also be enlarged in the lateral direction. Further, if the lateral interval between the tub and drum is reduced, the drum may be expanded in the lateral direction in direct proportion. When the lateral interval between the tub and the drum is reduced, the vibration of the drum in the lateral direction may be considered. The weaker the vibration of the drum in the lateral direction, the more expanded is the diameter of the drum. Therefore, the suspension unit to reduce the vibration of the drum may be designed such that rigidity of the suspension unit in the lateral direction is greater than rigidities of the suspension unit in other directions. For example, the suspension unit may be designed such that rigidity of the suspension unit against displacement in the lateral direction is greatest compared with rigidities of the suspension unit against displacements in other directions.

Further, the suspension unit may be directly connected to the bearing housing supporting the rotary shaft. That is, the bearing housing comprises a supporting portion to rotatably support the shaft and an extended portion extended from the supporting portion, and the suspension unit is attached to the supporting portion of the bearing housing or the extended portion of the bearing housing.

The suspension unit may include brackets extended in the axial direction. In a front loading type laundry machine, the brackets may be extended forward, namely towards a door.

The suspension unit may comprises at least two suspensions which are arranged distant from each other in the axial direction of the shaft.

The suspension unit may comprise suspensions placed below the shaft for standing support. The supported object (for example, the drum) is supported by the suspensions to stand alone.

Alternately, the suspension unit may comprise suspensions placed over the shaft for hanging support. In this case, the supported object is supported to be hung.

The mass center of the vibrating object(for example, a combination of the drum, the shaft, the bearing housing, and the motor) may be located, with respect to the center of the longitudinal length of the drum, at a side where the motor is located. In a front loading type laundry machine, the mass center may be located behind the longitudinal center of the drum. In this case, at least one suspension may be placed in front of or behind the mass center. One suspension may be placed in front of the mass center and another suspension behind the mass center.

The tub may be provided with an opening at a rear portion thereof. The drive assembly may be connected to the tub by a flexible member. The flexible member may seal between the tub and the drive assembly to prevent water from leaking through the opening of the rear portion of the tub, and allow the drive assembly to move relatively to the tub. The flexible member may be made of a flexible material which can do the sealing, for example, a gasket material like a front gasket. In this case, the flexible member may be referred to as a rear gasket for convenience. The rear gasket may be connected to the drive assembly under the condition that the rotation of the rear gasket at least in the rotational direction of the rotary shaft is constrained. In one embodiment, the flexible material may be directly connected to the shaft. In another embodiment, the flexible material may be connected to a portion of the bearing housing.

Further, a portion of the drive assembly, which is located radially inside the rear gasket and thus is likely to be exposed to the water in the tub, may be made so as no to be corroded by the water. For example, the portion of the drive assembly may be coated, or be surrounded with a separate member made of plastic such as the tub back(which will be described below). In a case where the portion of the drive assembly is made of metal, the portion may not be directly exposed to water by the coating or the separate plastic member, and thus corrosion of the portion may be prevented.

Further, the cabinet may not be necessary. For example, in a built-in laundry machine, the laundry machine without the cabinet may be installed within a space of a wall structure. However, even in this case, a front plate forming the front face of the laundry machine may be required.

Advantageous Effects of Invention

In an embodiment of the laundry machine according to the present invention, it may be possible to effectively avoid leakage of wash water, or to effectively prevent laundry or foreign matter from being caught between the tub and the drum.

BRIEF DESCRIPTION OF DRAWINGS

The accompanying drawings, which are included to provide a further understanding of the invention, illustrate embodiments of the invention and together with the description serve to explain the principle of the invention.

In the drawings.

MODE FOR THE INVENTION

Figure 1:
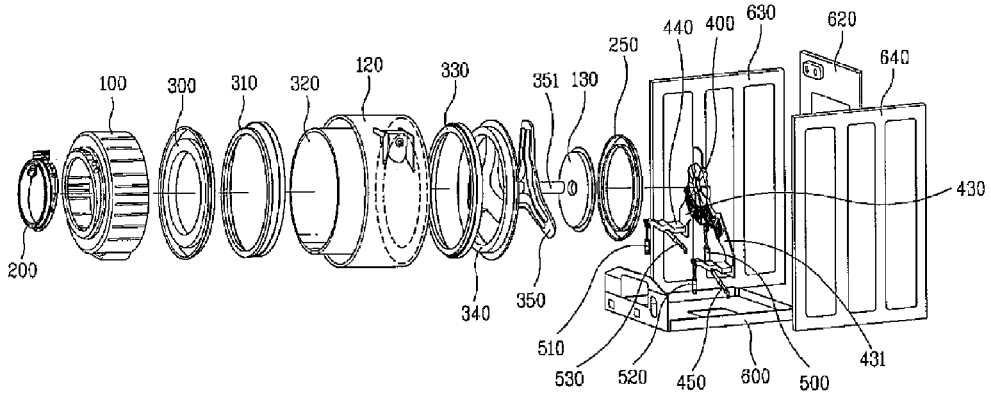
FIGS. 1 to 17 illustrate an exemplary embodiment of the present invention.
Figure 2:
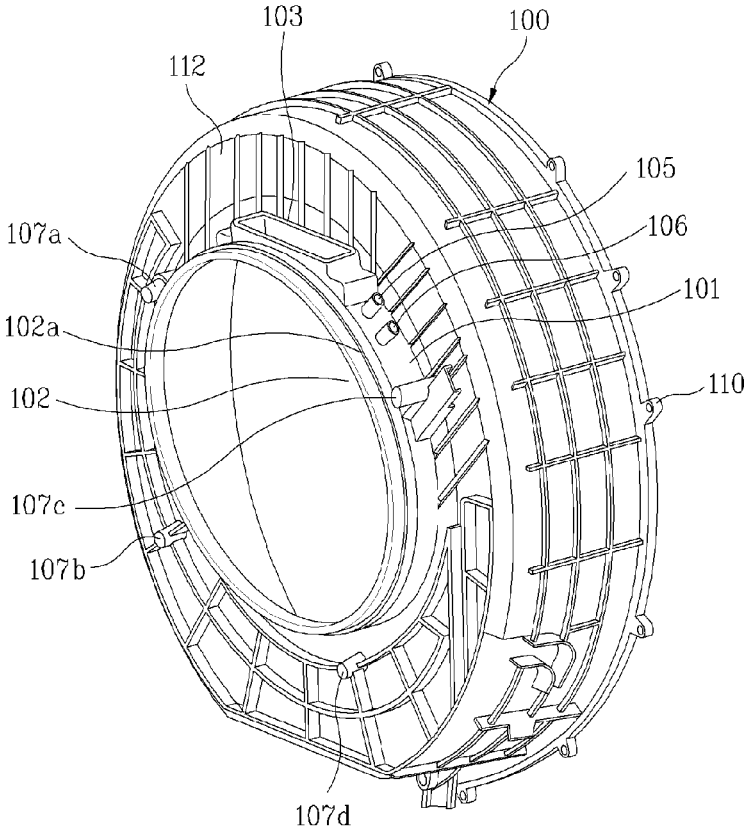
Figure 3:
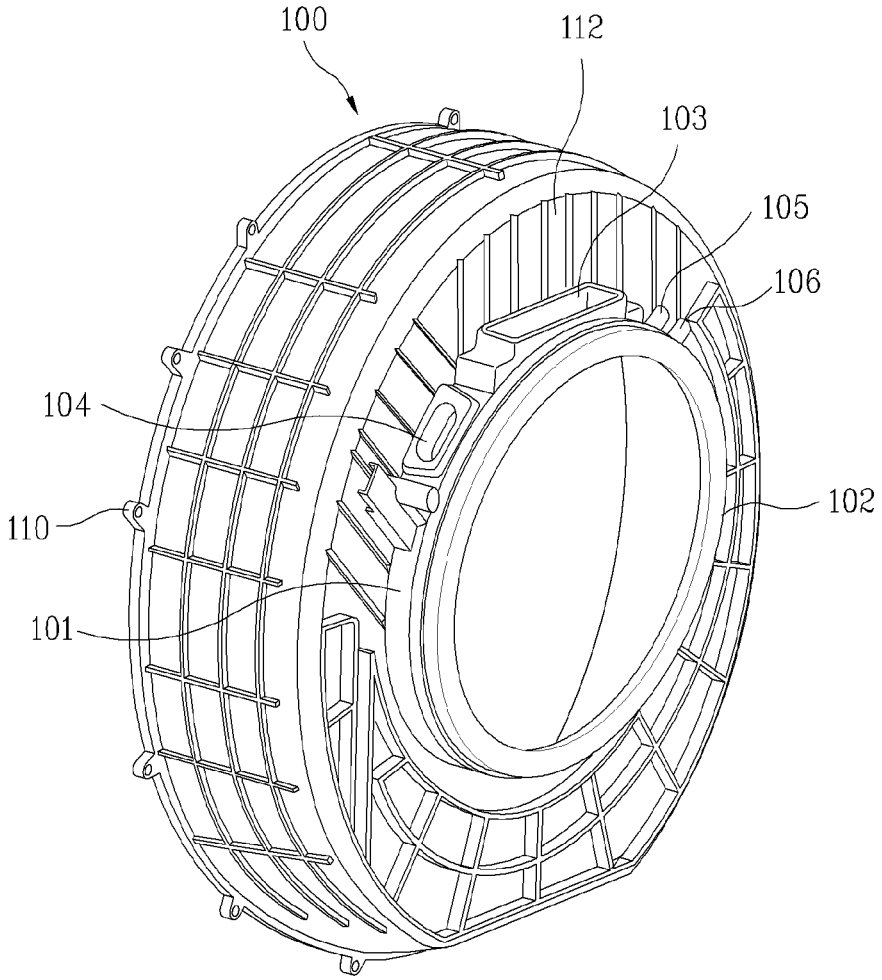

FIG. 1 is an exploded perspective view partially illustrating a laundry machine according to an exemplary embodiment of the present invention.

In the laundry machine, a tub is fixedly mounted to a cabinet. Of course, it may be unnecessary to fix the tub to the cabinet. The tub may be supported by a flexible support structure such as a suspension unit. Otherwise, the tub may be supported in a middle state between the state, in which the tub is supported by the suspension unit, and the state, in which the tub is completely fixed.

That is, the tub may be supported in a flexible state equivalent to that of the suspension unit, which will be described later. Alternatively, the tub may be supported in a rigid state, in which movement of the tub is more restrained than in the flexible state.

Different from the illustrated embodiment, the laundry machine need not include the cabinet. For example, in the case of a built-in laundry machine, a space, in which the laundry machine is to be installed, may be provided by a building wall structure, in place of the cabinet.

The tub includes a tub front 100, which forms a front section of the tub, and a tub rear 120, which forms a rear section of the tub.

The tub front 100 and tub rear 120 are assembled by screws. The assembled tub front 100 and tub rear 120 define therein a space to receive a drum. A rear gasket 250 is connected to an inner circumference of the tub rear 120 at a rear surface of the tub rear 120. A tub back 130 is connected to the rear gasket 250. The tub back 130 is centrally formed with a through hole, through which a rotating shaft extends.

The rear gasket 250 is connected between the tub back 130 and the tub rear 120, to provide a seal between the tub back 130 and the tub rear 120, and thus to prevent wash water from leaking outwardly. The tub back 130 is vibrated, together with the drum, during rotation of the drum. For this reason, the tub back 130 is sufficiently spaced from the tub rear 120, in order to prevent the tub back 130 from interfering with the tub rear 120 during rotation of the drum. The rear gasket 250 is made of a flexible material. Accordingly, the rear gasket 250 allows the tub back 130 to move relative to the tub rear 120 without interfering with the tub rear 120. The rear gasket 250 may have a bellows portion extendable to a sufficient length to allow the relative movement of the tub back 130. Although the rear gasket 250 is connected to the tub back 130 in the illustrated embodiment, the present invention is not limited thereto. The rear gasket 250 not only provides a seal between the tub and a driver including a rotating shaft 351, a bearing housing 400, etc., but also allows the driver to move relative to the tub. Thus, the rear gasket 250 may not be limited in terms of the type thereof and objects, to which the rear gasket 250 is connected, so long as the rear gasket 250 achieves the above-described functions.

A flexible member 200, which will be described in detail later, as a front gasket, is installed at the front of the tub front 100.

The drum includes a drum front 300, a drum center 320, and a drum back 340. Ball balancers 310 and 330 are installed at front and rear sides of the drum. A spider 350 is connected to the drum back 340. The spider 350 is connected to the rotating shaft 351. The drum is rotated within the tub by a rotating force transmitted to the drum via the rotating shaft 351.

The rotating shaft 351 extends through the tub back 130, and is connected to a motor 480. In the illustrated embodiment, the motor 480 is concentrically connected with the rotating shaft 351. That is, the motor 480 is directly connected with the rotating shaft 351 in the illustrated embodiment. In detail, a rotor of the motor 480 is directly connected with the rotating shaft 351. Of course, the motor 480 and rotating shaft 351 may be connected via a belt without being directly connected. That is, the motor 480 and rotating shaft 351 may be indirectly connected.

The bearing housing 400 is coupled to a rear wall 128 of the tub back 130. The bearing housing 400 rotatably supports the rotating shaft 351 between the motor 480 and the tub back 130.

A stator 80 is fixed installed in the bearing housing 400. The rotor is arranged to surround the stator 80. As described above, the rotor is directly connected with the rotating shaft 351. The motor 480 is of an outer rotor type, so that it is directly connected with the rotating shaft 351.

The bearing housing 400 is supported by a cabinet base 600 via a suspension unit. The suspension unit includes three vertical supports and two slant supports to support the bearing housing 400 in a direction that is slanted with respect to a front-to-rear direction. The suspension unit is connected to the cabinet base 600 without being completely fixed to the cabinet base 600. That is, the suspension unit is connected to the cabinet base 600 in a state of being allowed to be elastically deformed, thereby allowing the drum to move in front-to-rear and left-to-right directions. That is, the suspension unit is elastically supported to be pivotable within a certain angle in the front-to-rear and left-to-right directions about each support point thereof, at which the suspension unit is connected to the cabinet base 600. For such elastic support, the vertical supports of the suspension unit may be installed on the base 600 via rubber bushings.

The vertical supports of the suspension unit, which are vertically installed, function to elastically damp the vibration of the drum, whereas the slant supports of the suspension unit, which are slantingly installed, function to attenuate the vibration of the drum. In this connection, in a vibrating system including a spring and a damping means, the suspension unit may be configured such that the vertical supports function as the spring, and the slant supports function as the damping means.

The tub is supported by the cabinet. The vibration of the drum is damped by the suspension unit. Practically, the support structures for the tub and drum may be considered separate structures. Also, the support structures may be considered as being configured to prevent the vibration of the drum from being directly transmitted to the tub.

The tub front 100 includes a cylindrical wall constituting a portion of a side wall of the tub, and a donut-shaped substantially-flat front wall 112 formed at a front end of the cylindrical wall. The tub front 100 also has an open rear end. At the rear end, the tub front 100 has a plurality of fastening holes 110. The fastening holes 110 are aligned with corresponding fastening holes of the tub rear 120, to fasten the tub front 100 and tub rear 120.

A rim 101 extends forwardly from an inner circumference of the front wall 112 of the tub front 100. The rim 101 has a front-to-rear width gradually reduced as the rim 101 extends from the top thereof to the bottom thereof. The rim 101 need not be formed at the bottom of the front wall 112.

The rim 101 is formed with a water supply port 104 for supplying wash water, a hot air inlet 103 to be used in a drying operation, a circulating water inlet 106, into which wash water circulated by a circulation pump is introduced, a steam port 105, into which steam is introduced, etc.

The hot air inlet 103 extends upwardly from the rim 101 and has a substantially rectangular cross-section. The hot air inlet 103 is needed in the case of a washing machine having a drying function. The hot air inlet 103 need not be formed in the case of a washing machine having no drying function.

Since the water supply port 104, etc. are formed at the front side of the tub front 100, as described above, the supply of wash water, etc. is carried out at the front side of the tub.

The water supply port 104, etc. may be arranged forwardly of the front end of the drum received in the tub. In this case, accordingly, the wash water, etc. may be directly introduced into the drum through an opening provided at the drum. In this case, it is possible to more effectively treat laundry because fluids supplied to treat the laundry, namely, the wash water, etc., can be directly introduced into the drum. Where a detergent is supplied from a detergent box when the wash water is supplied, it is possible to reduce the amount of the detergent that is used, if the detergent can be directly introduced into the drum. In this case, it is also possible to reduce the amount of the wash water that is used. Also, it is possible to reduce a problem of contamination caused by detergent sediments accumulated on the bottom of the tub. In addition, there may be an effect of cleaning a door glass (not shown) by wash water when the wash water is supplied from the front side of the tub.

Even when hot air is supplied from the front side of the tub, the supply of the hot air may be ineffectively carried out in the case in which the hot air is supplied through the vertical wall of the tub front 100. This is because the path, along which the hot air flows, has a complex 90-rotated U-shaped structure having two bent portions (In this case, the hot air flows from the rear side of the tub to the front side of the tub, flows downwardly at the front side of the tub along one bent portion of the path, and then flows to the vertical wall of the tub along the other bent portion of the path.) However, where the hot air inlet 103 is formed at the rim 101 of the tub front 100, the path, along which the hot air flows, has a single bent portion, so that the hot air can smoothly flow.

The water supply port 104, etc. are arranged above the center of the drum. The wash water, etc. are supplied to the interior of the drum through an upper portion of the drum at the front side of the drum. If it is necessary to supply the wash water, etc. to the interior of the drum through a lower portion of the drum at the front side of the drum, different from the above-described case, the rim 101 of the tub front 100 may be formed at the bottom of the front wall 112. Also, if it is necessary to supply the wash water, etc. in a lateral direction, different from the above-described case, in which the wash water, etc. are supplied in a vertical direction, the rim 101 may be formed in the vicinity of a central portion 131 of the front wall 112. That is, the structure of the rim 101 may be varied in accordance with the supply direction of fluids to be supplied.

A coupler 102 is formed at a front end of the rim 101, to couple the front gasket 200, which will be described later. The coupler 102 extends forwardly by a relatively-short length from the front end of the rim 101 such that the coupler 102 has a substantially cylindrical shape. A rib 102*a* is formed on an outer circumferential surface of the coupler 102.

The coupling of the front gasket 200 is achieved as the coupler 102 is fitted into the front gasket 200. To this end, the front gasket 200 is formed, at an inner circumferential surface thereof, with a fitting groove, with which the rib 102*a* formed at the outer circumferential surface of the coupler 102 is engagable. This will be described in more detail later.

The tub front 100 is fixedly connected to a cabinet front 610. For this fixed connection, four clamping bosses 107 are formed at the front wall 112 of the tub front 100 around the rim 101. The cabinet front 610 is arranged at a desired position under the condition that the tub front 100 is installed, and is then fastened to the tub front 100 by fastening screws in a front-to-rear direction.

The tub rear 120 may be fixedly connected, at the rear wall thereof, to the cabinet. The tub front 100 and/or the tub rear 120 may be supported by the cabinet in a state of being seated on the base of the cabinet.

Figure 4:
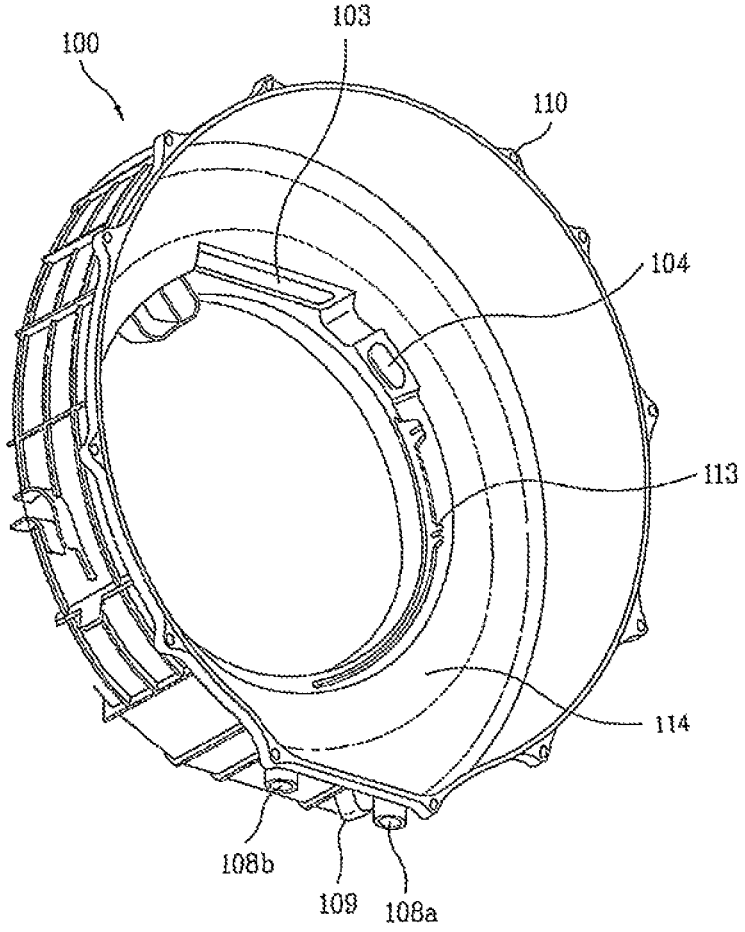

FIG. 4 is a view showing the interior of the tub front 100 at the rear side.

The steam port 105 may be connected to a steam hose. A steam guide 105*a* is provided to guide steam emerging from the steam port 105 toward the inside of the drum. A circulating water guide 106*a* is also provided to guide circulating water emerging from the circulating water inlet 106 toward the inside of the drum. The steam port 105, circulating water inlet 106, steam guide 105*a*, circulating water guide 106*a*, etc. are integrally formed at the tub front 100. The tub front 100 is formed through a plastic injection molding process. At this time, the steam port 105, etc. are injection-molded together with the tub front 100, as a part of the tub front 100.

A base coupler is formed at the bottom of the tub front 100, to seat the tub front 100 on the cabinet base. The base coupler includes a first hollow coupler 108*a* and a second hollow coupler 108*b*, each of which has a cylindrical shape. The base coupler also includes a first screw coupler 109 for screw fastening. A screw is fastened through the first screw coupler 109 in a front-to-rear direction under the condition that the tub front 100 is arranged on the base 600, so that the tub front 100 is firmly coupled to the base 600.

The tub front 100 is coupled with the tub rear 120, thereby forming a space to receive the drum. The tub front 100 and tub rear 120 are fastened to each other by screws. For this screw fastening, a plurality of screw fastening holes 110 is formed along a circumference of the tub front 100 at the rear end of the tub front 100.

Figure 5:
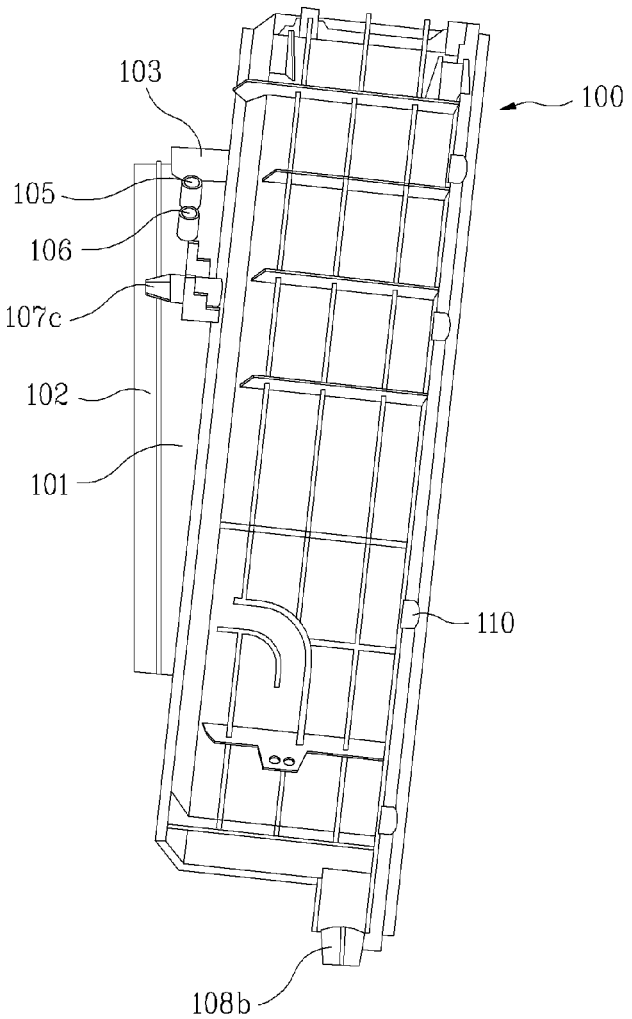
Figure 6:
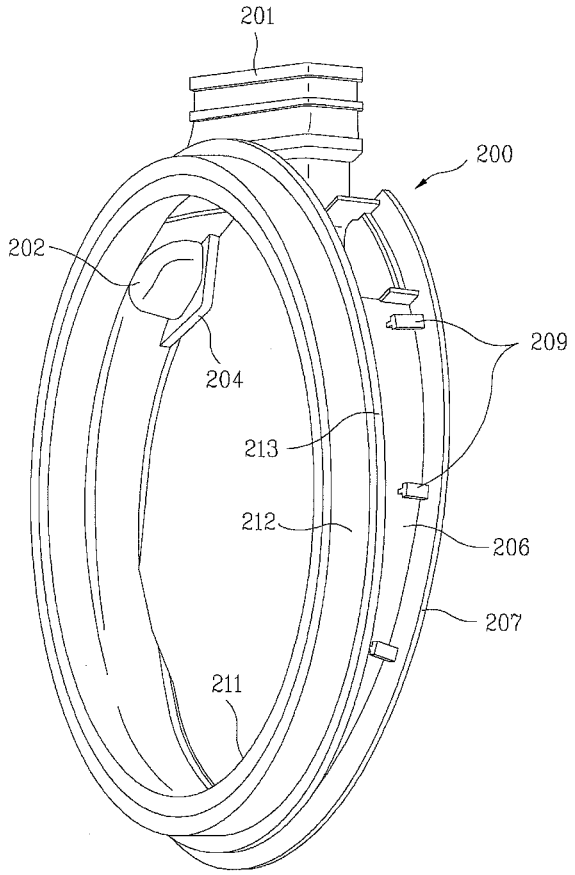
Figure 7:
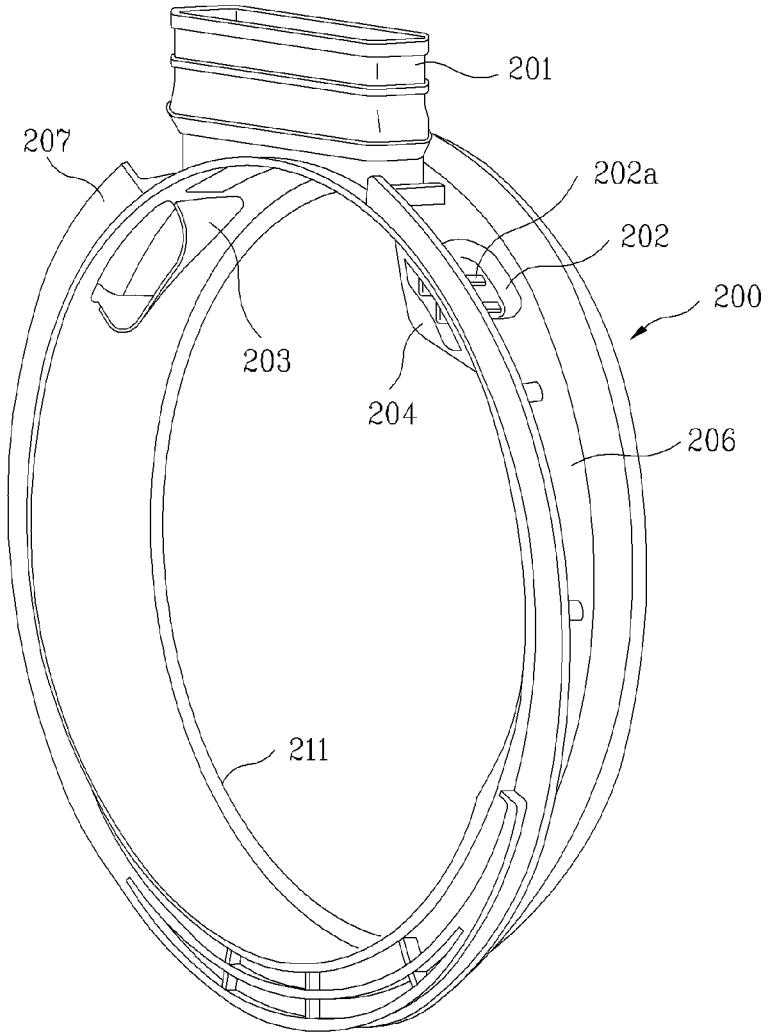
Figure 8:
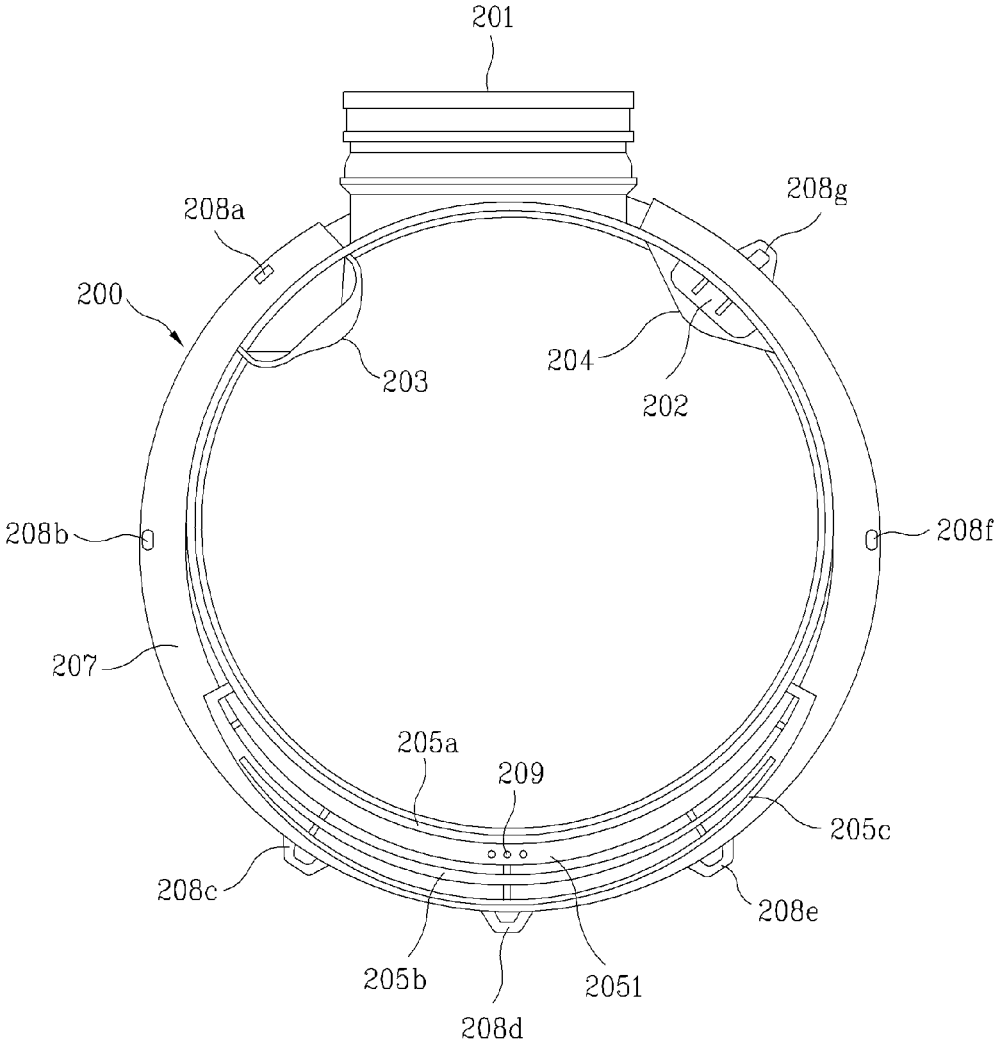

FIG. 5 is a side view of the tub front 100. As shown in FIG. 5, the cylindrical wall of the tub front 100, which surrounds the drum, is upwardly tilted at the front side thereof.

Since the drum is arranged such that the front side thereof is upwardly tilted in the illustrated embodiment, the tub is also arranged such that the cylindrical wall thereof is tilted.

As described above, the rim 101 of the tub front 100 has a width gradually reduced as the rim 101 extends from the top thereof to the bottom thereof. Referring to FIG. 5, the opening of the tub, through which laundry is loaded or unloaded, is directed to the front side without being tilted, in accordance with the shape of the rim 101. That is, the laundry loading/unloading opening of the tub may be formed to be slightly tilted in a rearward direction.

FIGS. 6 to 12 illustrate an embodiment of the front gasket 200, which is coupled to the front end of the tub front 100.

The front gasket 200 may be configured to perform a single function or several functions. Although the front gasket 200 has a single gasket structure to perform several functions in the illustrated embodiment, it may be divided into a plurality of gasket structures corresponding to respective functions. Also, each of the functions may be independent, and is not required to be dependent on the remaining functions.

First, a foreign matter cutoff function of the front gasket 200 will be described. The foreign matter cutoff function serves to cut off foreign matter, in order to prevent foreign matter (for example, laundry or coins dropped out of laundry) from being caught or held between the tub and the drum.

Figure 9:
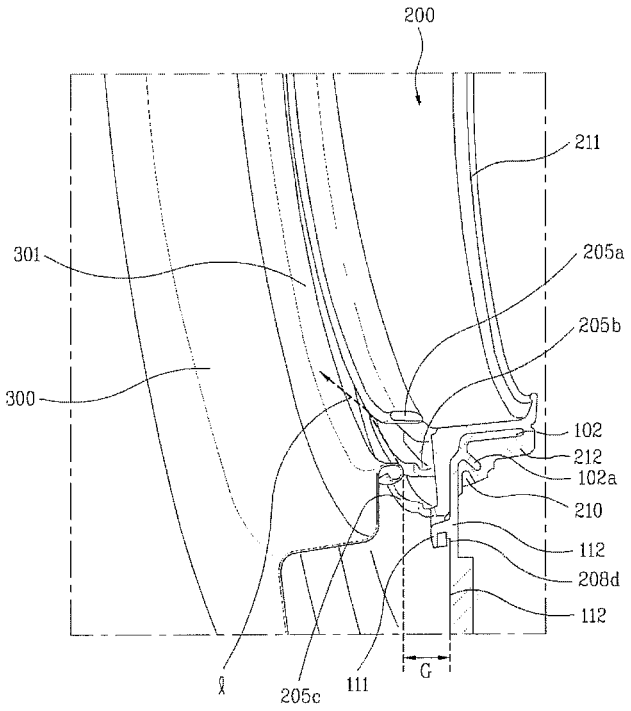

As shown in FIG. 9, the laundry machine of FIG. 1 may have a gap G extending in a rotating axis direction between the tub and the drum. That is, as shown in FIG. 9, the inner surface of the front wall of the tub and the front end of the drum are spaced apart from each other in the rotating axis direction. The front gasket 200 prevents foreign matter from being caught in the axial gap G.

Figure 11:
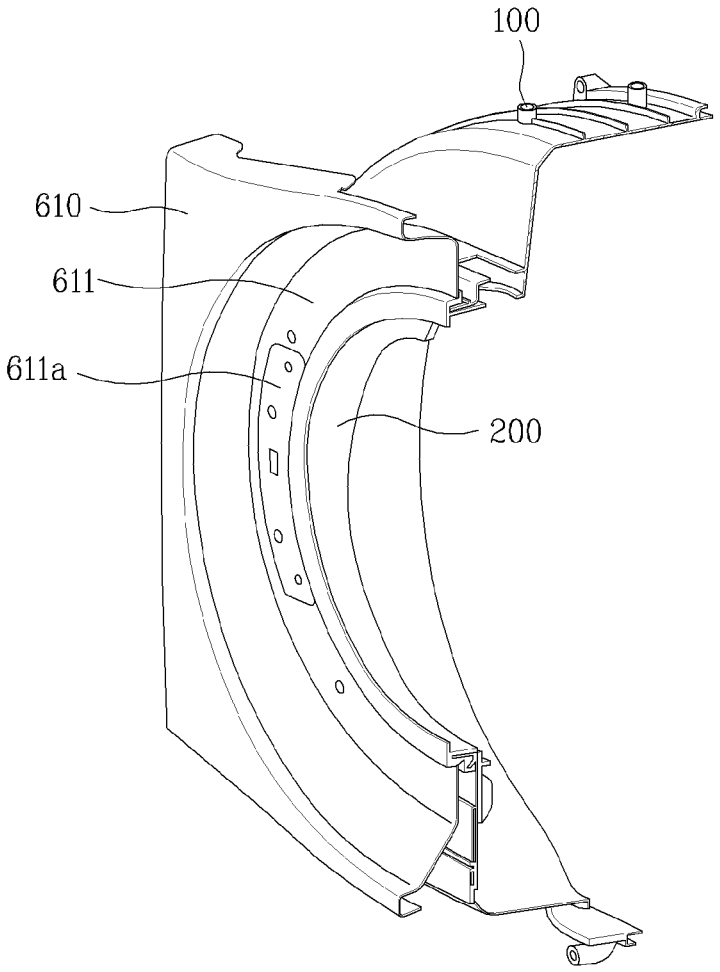

Now, the foreign matter cutoff function will be described in more detail. FIG. 11 is a view showing the front gasket 200 at the rear side. The front gasket 200 has a foreign matter catch preventing member (or a foreign matter cutoff member) positioned at the axial gap while being rearwardly protruded.

The foreign matter cutoff member includes a plurality of rearwardly protruded ribs. The ribs are referred to as a first rib 205*a*, a second rib 205*b*, and a third rib 205*c*, starting from the uppermost one thereof.

The first rib 205*a* may be rearwardly protruded to a longer length than the ribs arranged beneath the first rib 205*a*. Since the drum is arranged in a tilted state, a lower portion of the front end of the drum may be moved when the drum is forwardly inclined. To this end, the second and third ribs 205*b* and 205*c*, which are arranged beneath the first rib 205*a*, may have shorter lengths than the first rib 205*a*.

Since foreign matter may be mainly introduced through the lower portion of the front end of the drum, the above-described ribs may be formed only at the lower portion of the front end. Where the ribs are formed even at an upper portion of the front end, the number of ribs formed at the lower portion may be greater than that at the upper portion. Of course, it may be possible to form the ribs such that the number of ribs formed at the upper portion is equal to or greater than that at the lower portion.

This will be described in more detail with reference to FIG. 9.

The first rib 205*a* may be positioned inwardly of the opening of the drum in a radial direction. A plurality of auxiliary ribs 2051 are formed at each lower surface of the first rib 205*a*, second rib 205*b*, and third rib 205*c*, in order to support the associated rib, and thus to prevent the associated rib from being downwardly loosened.

The first rib 205*a* may have a smaller radius than the front end 301 of the drum, and may be elongated to extend rearwardly beyond the drum front end 301. When the user views a lower portion of the drum front end 301 at the front side after opening a door, the lower portion of the drum front end 301 is hidden from view by the first rib 205*a*.

The second rib 205*b* and third rib 205*c* are formed, taking into consideration the fact that the drum front end 301 may be downwardly moved in accordance with vertical pivotal movement thereof. Since the drum front end 301 may be slightly moved in a forward direction, the second rib 205*b* and third rib 205*c* may be formed to have a shorter length than the first rib 205*a*.

As shown in FIG. 9, the first rib 205*a* is arranged above the lower portion of the drum front end 301 while extending rearwardly beyond the drum front end 301. That is, the first rib 205*a* extends into the interior of the drum while maintaining a certain spacing from the drum front end 301. The extension length of the first rib 205*a* may be limited such that the first rib 205*a* does not come into contact with the drum front end 301, taking into consideration the pivotal movement trace 1, along which the lower portion of the drum front end 301 moves pivotally in a vertical direction.

Each of the second rib 205*b* and third rib 205*c* may be arranged to maintain a spacing preventing an associated one of the second rib 205*b* and third rib 205*c* from coming into contact with the drum front end 301 when the drum rotates normally during a spin-drying operation.

The spacing of each of the first rib 205*a*, second rib 205*b*, and third rib 205*c* may be determined such that the associated rib does not interfere with the drum when the drum rotates normally at high speed. In particular, the spacing may be determined such that each rib does not interfere with the drum when the drum rotates normally at a high speed of 400 rpm or more. At a speed lower than 400 rpm, excessive vibration may be generated due to resonance. However, such excessive vibration will be temporarily generated. Also, the displacement of the vibration is large. For this reason, the contact between the tips of the ribs and the drum front end occurs temporarily and locally. As a result, there is minimal possibility of the ribs being abraded. However, if such contact occurs even in a normal state at a speed of 400 rpm or more, this phenomenon may be continued, so that there may be a problem of abrasion of the ribs. That is, the spacing between each rib and the drum may be determined such that each rib does not interfere with the drum at a rotating speed of 400 rpm or more, even though the interference may occur at a rotating speed of lower than 400 rpm.

The first rib 205*a*, second rib 205*b*, and third rib 205*c* may be provided only at the lower portion of the front gasket 200. This is because the possibility that foreign matter and laundry are caught between the drum and the tub is increased at the lower portion of the drum front end. For this reason, the ribs may be formed over a region corresponding to a lower 180 region of the drum front end 301. Of course, the ribs may be formed over a region extending through an angle of more than 180 because laundry may be caught at the left and right sides of the drum front end. In this case, the ribs may have a length gradually reduced as they extend upwardly, because the lateral displacement of the drum front end may be relatively small.

Figure 13:
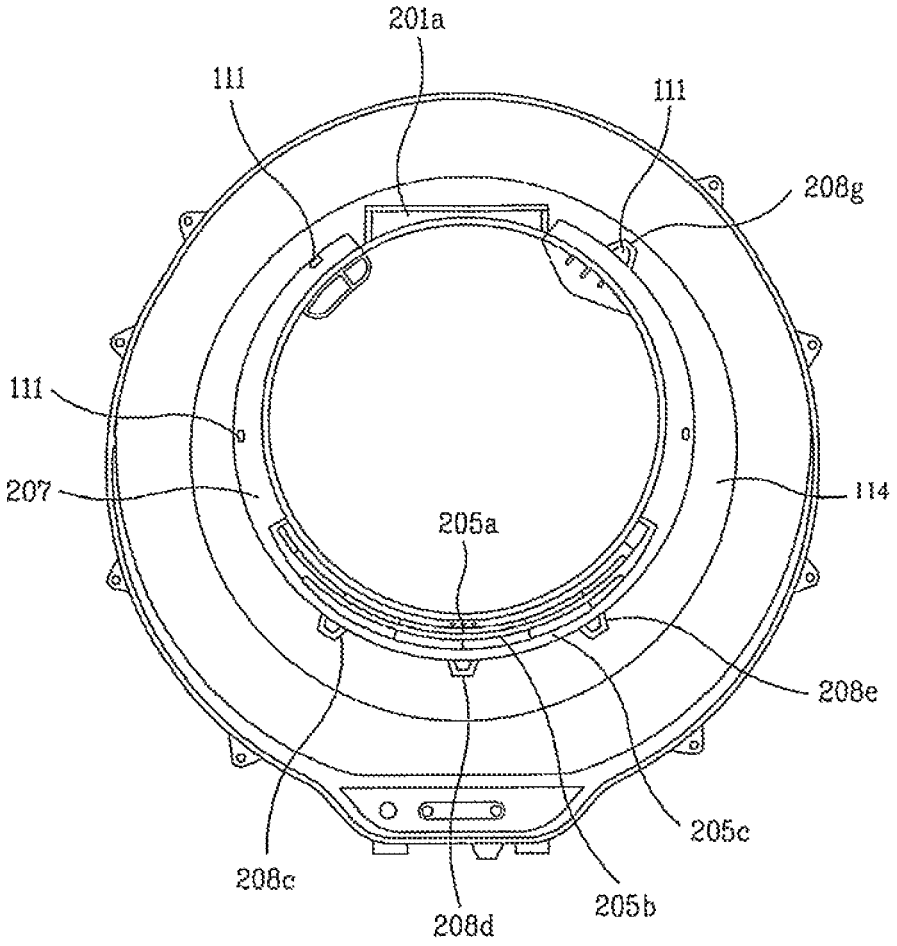

Meanwhile, as shown in FIG. 13, a slant surface 114 is provided at the inner surface of the front wall of the tub front 100. A flange 207 formed at the front gasket 200 is seated on the slant surface 114. The slant surface 120 is inclined such that it is forwardly protruded as it approximates the center of the tub front 100 in a radial direction. The front end of the drum may be moved while pivoting vertically. In particular, the lower portion of the drum front end may be downwardly moved while pivoting vertically. At this time, the slant surface 114 reduces the spacing between the inner surface of the front wall of the tub front 100 and the front end of the drum, as much as possible. Accordingly, there may be an advantage in that it is possible to prevent foreign matter or laundry from being caught in the spacing.

It is unnecessary to provide the ribs 205 for cutoff of foreign matter in plural. If necessary, the number of the ribs 205 may be increased or decreased.

Hereinafter, the sealing between the cabinet front, namely, the frame forming the outer appearance of the front side of the laundry machine, and the tub will be described. The tub is formed, at the front wall thereof, with an opening, through which laundry is loaded or unloaded. Since wash water may be discharged through the opening, it is necessary to prevent this phenomenon.

In a conventional laundry machine having a general configuration, the laundry loading/unloading opening of the tub is arranged at a position rearwardly spaced apart from the cabinet front 610 by a certain distance. In such a structure, wash water may be introduced into the cabinet through the front opening of the tub. In order to avoid such a phenomenon, a seal is provided between the front opening of the tub and the cabinet in the conventional laundry machine. For this sealing, a gasket is connected between the front opening of the tub and the cabinet front 610. In the laundry machine in the illustrated embodiment, however, the front opening of the tub is formed such that it is outwardly protruded through the cabinet front 610. Accordingly, there is very little possibility of wash water being introduced between the cabinet and the tub. If a seal is provided between the front end of the front opening of the tub and a door surface (in particular, a door glass), in this case, it is possible to prevent wash water from leaking outwardly through the front opening in a closed state of the door.

In order to provide such a water leakage preventing function, the front gasket 200 may include a door seal 211. The door seal 211 may be formed in the vicinity of a region where the front gasket 200 is coupled to the front opening of the tub. The door seal 211 may be rearwardly pushed by the door glass when the door is closed. In this case, it is desirable to support the door seal 211 against a force pushing the door seal 211, in order to bring the door seal 211 into close contact with the door glass, and thus to secure a sealing effect. To this end, the door seal 211 is formed in the vicinity of the above-described coupling region.

The door seal will be described in more detail with reference to FIG. 12.

A front gasket coupler 102 extends forwardly (toward the door) from the front wall of the tub. The front gasket coupler 102 is protruded forwardly of the cabinet front 610. A door seat surface, which is rearwardly concave, is formed at the cabinet front 610, for mounting of the door. An opening corresponding to the front opening of the tub is centrally defined through the door seat surface. A front end of the front gasket coupler 102 is forwardly protruded beyond the opening of the cabinet front 610.

The front gasket 200 is coupled to the front gasket coupler 102. The door seal 211 extends inwardly in a radial direction from the inner circumference of the front gasket 200 in the above-described coupling region.

The front gasket 200 is formed with a coupling portion 212, which is seated on an outer circumferential surface of the front gasket coupler 102. The coupling portion 212 is pressed by a coupling ring 189 under the condition that the coupling portion 212 is seated on the outer circumferential surface of the front gasket coupler 102, so that the front gasket 200 is firmly coupled to the front gasket coupler 102.

The front gasket coupler 102 is formed, at the outer circumferential surface thereof, with a groove. In the groove, a part of the coupling portion 212 and the coupling ring 189 are fitted. The groove may be defined by the rib 102*a* formed at the outer circumferential surface of the front gasket coupler 102 and a wall of the rim 101 of the tub arranged at the rear side of the rib 102*a*.

The opening of the cabinet front 610 may also be seated on the outer circumferential surface of the coupling portion 212. A rib is outwardly protruded in a radial direction from the coupling portion 212. The rib is seated on the inner surface of the opening of the cabinet front 610.

The front gasket 200 is formed with a rim 206 corresponding to the rim 101 of the tub front 100. The flange 207, which is seated on the inner surface of the front end 12 of the tub front 100, is formed at a rear portion of the rim 206. A plurality of coupling grooves 208 may be formed at the flange 207. The coupling grooves 208 are coupled with protrusions 111 formed at the tub front 100. The front gasket 200 is coupled to the tub by the coupling portion 212 at the front side of the front gasket 200 and by the flange 207 at the rear side of the front gasket 200.

Meanwhile, the above-described foreign matter cutoff member is formed at the flange 207. The flange 207 also performs a damping function when the front end of the drum strikes the inner surface of the front wall 112 of the tub. The flange 207 also functions to couple the front gasket 200 thereto.

The rim 206 functions as a connector for connecting the flange 207 and the coupling portion 212.

A duct connector 201, which will be connected with a drying duct 40, is formed at an upper portion of the rim 206 of the front gasket 200. The duct connector 201 is inserted into the hot air inlet 103 of the tub front 100. Hot air supplied through the drying duct 40 is introduced into the tub via the duct connector 201.

Where the laundry machine does not have a drying function, the connector for the drying duct 40 may not be needed. Of course, even in this case, the duct connector 201 may have a closed structure, in place of a hollow structure, if the hot air inlet 103 formed at the rim 101 of the tub front 100 remains. In this case, the duct connector 201 closes the hot air inlet 103. Thus, the structure of the front gasket 200 may be slightly varied in accordance with whether or not the drying function is provided.

A water supply guide 202 is formed at the rim 206 of the front gasket 200 such that the water supply guide 202 corresponds to the water supply port 104. The water supply guide 202 is shaped to guide wash water to the interior of the drum. The cross-section of the water supply guide 202 may have an L-shape. A partition wall 202*a* is formed in the water supply guide 202.

A laundry stopper 204 is formed at a rear portion of the water supply guide 202, to prevent laundry from emerging forwardly. Laundry, which moves in the drum, may be forwardly pushed and discharged. Such a phenomenon is prevented by the laundry stopper 204. The laundry stopper 204 has a triangular shape, in order to prevent rotation of laundry from being obstructed by the laundry stopper 204, as much as possible.

A guide cover 203 is formed at the front gasket 200, to surround the steam guide 105*a* and circulating water guide 106*a* of the tub front 100.

The coupling grooves 208 is formed at the flange 207, to be engaged with the protrusions 111 formed at the inner surface of the tub front 100. Referring to FIG. 9, the engagement state of the coupling grooves 208 and protrusions 111 is shown.

Figure 10:
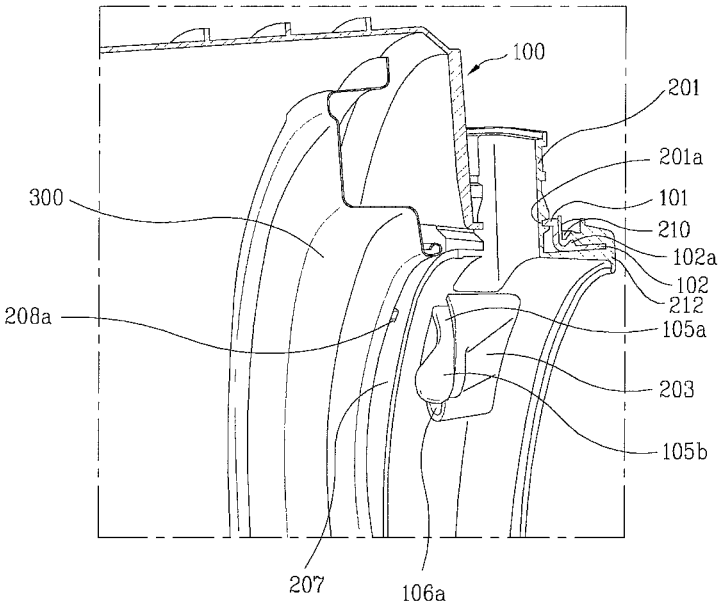

FIGS. 9 and 10 show sectional perspective views of the drum, front gasket 200, and tub front 100. As shown in the drawings, the front gasket 200 is fitted around the front gasket coupler 102 formed as a cylindrical structure at the front wall of the tub front 100, so that the front gasket 200 is coupled to the front gasket coupler 102. The rib 102*a* is formed at the front gasket coupler 102. The front gasket 200 has a ring portion 210 arranged at the rear side of the rib 102*a*. The ring portion 210 is formed with a groove, in which the coupling ring (not shown) to couple the front gasket 200 to the tub front 100 is fitted.

The door seal 211 is formed at a front portion of the front gasket 200, to come into contact with the door glass (not shown), and thus to prevent leakage of water. In a closed state of the door, the door seal is in close contact with the door glass, thereby preventing leakage of water. The door seal 211 is shaped to extend inwardly in a radial direction from the front portion of the front gasket 200.

Meanwhile, referring to FIG. 10, a protrusion 105*b* is shown. The protrusion 105*b* is arranged beneath the steam guide 105*a* and circulating water guide 106*a*. The protrusion 105*b* performs a similar function to the laundry stopper 204.

Figure 12:
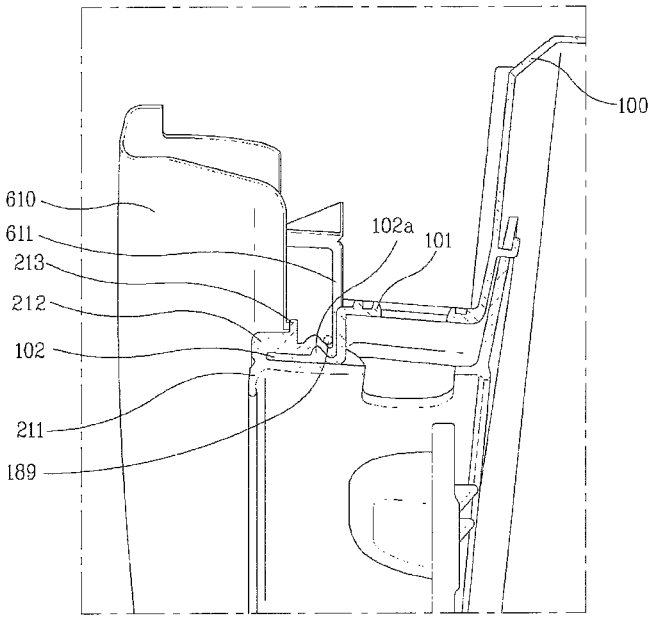

FIGS. 11 and 12 show partial sectional views of the cabinet front 610, tub front 100, and front gasket 200. The cabinet front 610 is formed with a door frame portion 611 corresponding to a frame of the door. A door coupler 611*a* is formed at the door frame portion 611, to hinge the door to the cabinet front 610.

Referring to FIG. 12, the front gasket coupler 102 of the tub front 100 is forwardly protruded beyond the door frame portion 611. That is, the front opening of the tub is protruded outwardly of the cabinet front 610.

Since the front gasket coupler 102 of the tub front 100 extends to a region near the door frame portion 611, the front end of the coupler 102 is positioned near the door glass. Accordingly, the door seal 211 of the front gasket 200 can be formed to have a simple structure having a short length.

It is unnecessary to fixedly couple the front gasket 200 to the cabinet front 610. The front gasket 200 may only be in contact with the cabinet front 610 in a non-fixing manner.

Meanwhile, a slide engagement protrusion 209 may further be provided at the rim 206. The slide engagement protrusion 209 is engaged in a slide engagement groove 113 provided at a corresponding portion of the inner surface of the tub front 100. As the front gasket 200 is forwardly moved within the tub, the slide engagement protrusion 209 is engaged in the slide engagement groove 113.

FIG. 13 shows a state in which the front gasket 200 is coupled to the tub front 100. In this state, the front portion of the front gasket 200 is coupled to the opening of the tub front 100 while being fitted around the opening of the tub front 100. The slide engagement protrusion 209 provided at the rim 206 of the front gasket 200 is slidably fitted into the slide engagement groove 113 provided at the inner surface of the rim 101 of the tub front 100, so that the slide engagement protrusion 209 and slide engagement groove 113 are engaged.

The front wall of the tub front 100 is fixedly coupled to the door frame 611 of the cabinet front 610 at four positions (FIG. 11). Accordingly, the door seal is supported by the tub fixedly coupled to the cabinet front 610 when the door is closed, so that the door seal is prevented from being rearwardly pushed. As a result, it is possible to secure sealing of the door glass.

The duct connector 201 provided at the front gasket 200 is inserted into the hot air inlet 103 of the tub front 100. Where the laundry machine does not have a drying function, the duct connector 201 may be closed. In this case, the duct connector 201 may have a reduced length. A plurality of coupling holes 208*a* to 208*g* is formed through the flange 207. The coupling holes 208*a* to 208*g* are fitted around the protrusions 111, which are provided at a rear surface of the tub front 100. The coupling of the front gasket 200 is achieved in a hanging or hook coupling manner at the lower portion thereof while being achieved in a slide coupling manner at the upper portion thereof. For the hook coupling, holes are formed at the front gasket 200, and protrusions such as hooks are formed at the inner surface of the front wall of the tub front 100, to be engaged in the holes. For the slide coupling, the slide engagement protrusions 209 are slidably fitted into the slide engagement grooves 112, so that they are engaged. The slide engagement protrusions 209 may have a T or 90-rotated L-shape.

The front gasket coupler 102 is inserted into the front portion of the front gasket 200 in a forward direction from the rear side. By virtue of this coupling structure, there is an advantage in that, even when the door seal 211 is deformed by the door glass as the door is closed, this deformation is not transmitted to the ribs 205 arranged at the rear side of the door seal 211 because the door seal 211 is supported by the front gasket coupler 102. Thus, the spacing between the ribs and the drum front end is maintained in a given design state, if possible.

The front gasket coupler 102 extends in the form of a cylindrical structure along the opening of the tub front 200. The front gasket coupler 102 is also provided with the rib 102*a* protruded along the outer circumferential surface of the front gasket coupler 102. The rib 102*a* is a single rib extending continuously along the outer surface of the front gasket coupler 102.

The rib 102*a* may have a length gradually increased as it extends from the top of the tub front 100 to the bottom of the tub front 100. This structure is implemented, taking into consideration the interference of the rib 102*a* with a front cabinet seat 213 of the front gasket 200 at the top of the tub front 100.

When the coupling ring 189 (FIG. 12) is subsequently fitted around the ring portion 210 of the front gasket 200, the coupling of the front gasket 200 to the tub front 100 is completed.

Meanwhile, a rib having the same function as the ribs 205 may be added. This will be described with reference to FIGS. 14, 15, and 16**.

A fourth rib 1201, which extends rearwardly from the flange 207, may be additionally provided. In particular, the fourth rib 1201 is formed to extend over an upper 180 portion of the flange 207. The fourth rib 1201 may be formed to extend even over a portion of the flange 207 arranged below the upper 180 portion, and thus to be arranged beneath the first rib 205*a*.

A pair of fifth ribs 1202, which are laterally opposite to each other, may be additionally formed to surround the fourth rib 1201. Each fifth rib 1202 may be connected to the second rib 205*b* or third rib 205*c* while extending continuously to an upper cut portion of the flange 207. The second rib 205*b* and third rib 205*c* may be joined to each other. Each fifth rib 1202 may be connected to a joined portion 205*bc* of the second rib 205*b* and third rib 205*c*.

A sixth rib 1203 may also be formed to surround the third rib 205*c*. The sixth rib 1203 may extend over a lower 180 portion of the flange 207.

Figure 14:
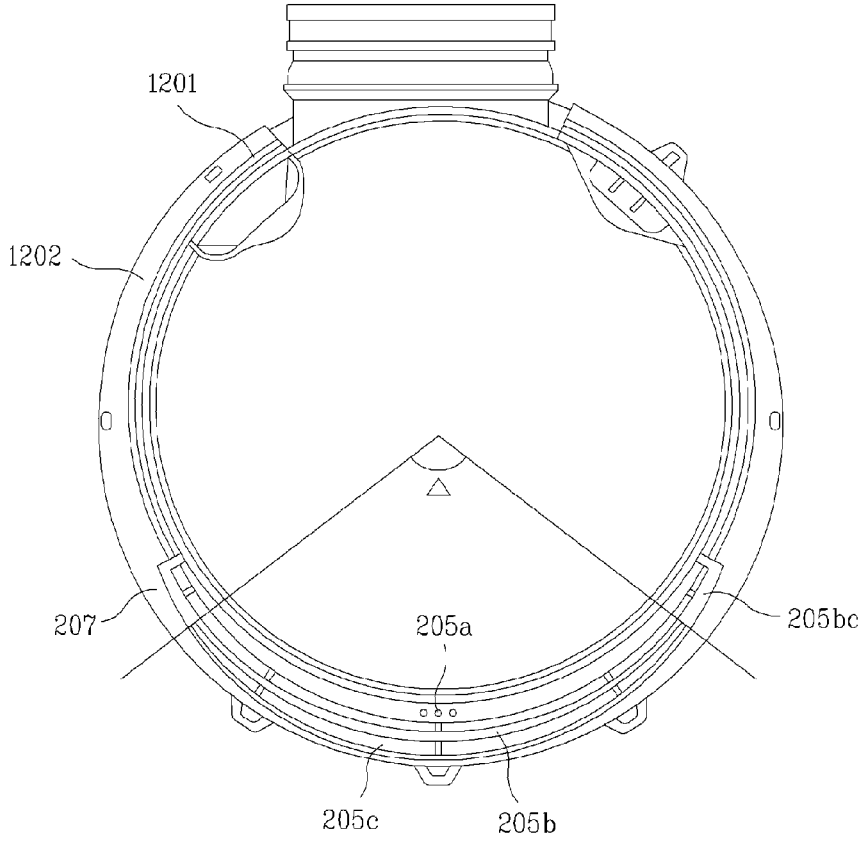
Figure 15:
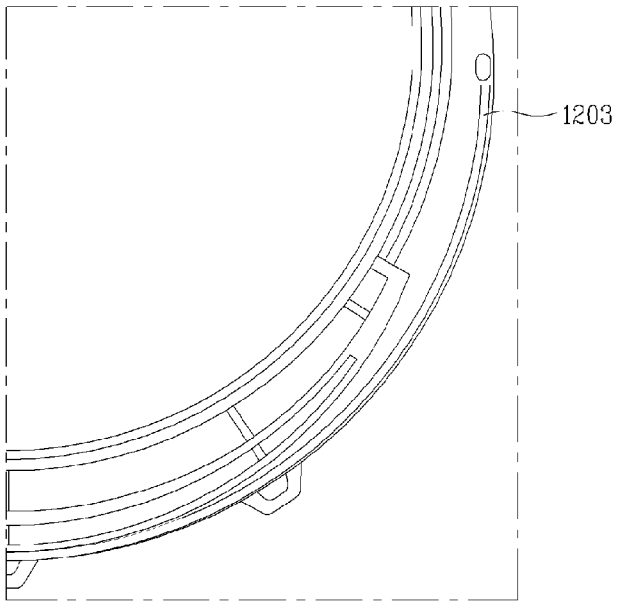

As described above, the possibility of foreign matter being caught between the drum and the tub is highest in a region corresponding to the lower portion of the drum front end 301. Since the drum front end 301 may be vertically moved, it is desirable to arrange a plurality of ribs in a region extending through a predetermined angle beneath the front gasket 200 such that the ribs form at least three layers. As shown in FIG. 14, the angle may be about 120. The ribs formed through the angle may form 5 layers.

The ribs, which function to compensate for variation in the spacing between the drum and the tub, and thus to prevent foreign matter from being caught in the spacing, may be configured to form at least two layers over the entirety of the drum front end 301. The ribs may be formed over the entirety of the front gasket 200, or may be formed on a portion of the inner surface of the front wall of the tub front 100.

Figure 16:
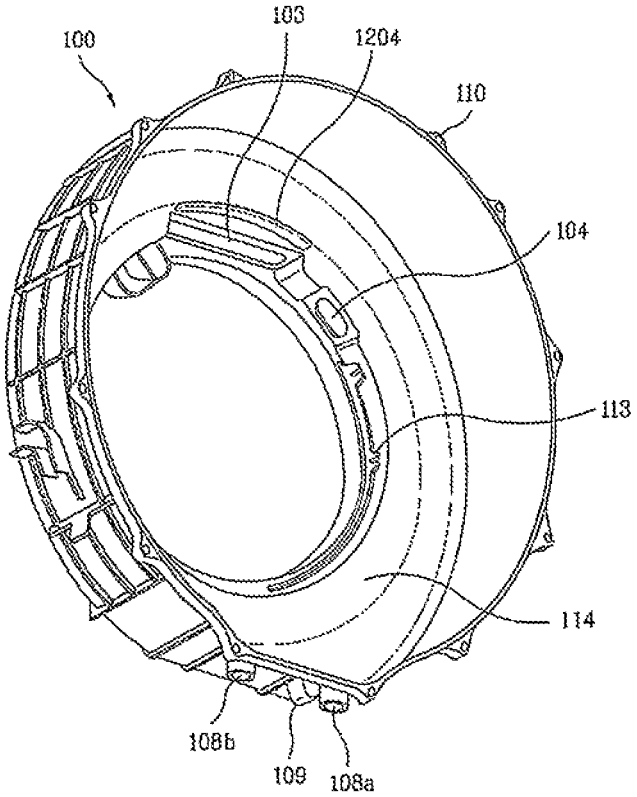

As shown in FIG. 16, the flange 207 may not be present on an upper portion of the front gasket 200 shown in FIG. 14, taking into consideration the interference of the flange 207 with the duct connector corresponding to the hot air inlet 103 of the tub front 100. In this case, the fifth ribs 1202 may be cut off at upper portions thereof. In order to cover the cutoff portions of the fifth ribs 1202, a tub-side gap compensating rib 1205 may be formed on a portion of the inner surface of the front wall of the tub front corresponding to the cutoff portions of the fifth ribs 1202. FIG. 16 shows the arrangement relations of the tub-side gap compensating rib 1204, fourth rib 1201, and fifth ribs 1202.

Meanwhile, the above-described ribs may be continuously formed in a circumferential direction, or may be intermittently formed in the circumferential direction such that they have cutoff portions.

Figure 17:
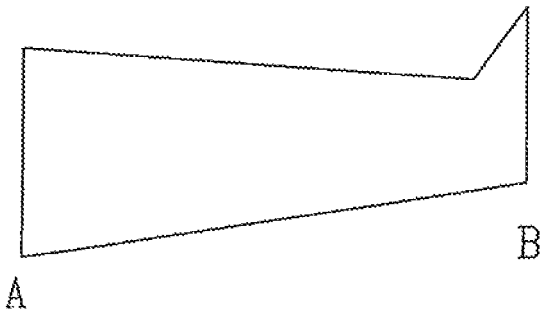

As shown in FIG. 17, each rib may have a cross-sectional shape having a thickness gradually reduced as the rib extends from an end A connected to the flange 207 to a tip end B. The tip end B may be inwardly bent in a radial direction. As the thickness of the tip end B is reduced, the vertical length of the tip end B may be reduced. In this case, there may be an adverse affect in association with cutoff of foreign matter, etc. To this end, the tip end is bent such that the rib securely has a vertical length equal to or longer than a predetermined length. Since the tip end B has a smaller thickness than the end A connected to the flange 207, it is relatively flexible. Accordingly, the tip end B can be flexibly deformed when it comes into contact with the drum. As a result, it is possible to reduce the problem of abrasion. In addition, there is an advantage in association with the maintenance of the tip end of the rib at a design position because the rib has a large thickness at the side of the flange.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention provides a laundry machine to treat laundry. In accordance with an exemplary embodiment of the present invention, the laundry machine may be configured to effectively prevent leakage of wash water, or to effectively prevent laundry or foreign matter from being introduced between the tub and the drum.

The invention claimed is:

1. A laundry machine, comprising:

a front frame including an opening, though which laundry is loaded or unloaded, the front frame forming front-side outer appearance;

a tub including a front wall formed with a rim that extends forward from an inner circumference of the front wall of the tub to a front side of the opening of the front frame and defines a laundry loading/unloading opening, wherein the front wall of the tub is fixedly coupled to the front frame;

a drum rotatable installed in the tub;

a drive including a rotational shaft connected to the drum, a bearing housing that supports the rotational shaft, and a motor that rotates the rotational shaft;

a suspension connected to the bearing housing, that dampens vibration of the drum;

a door mounted to the front frame, to open or close the laundry loading/unloading opening; and a front gasket including a coupling portion coupled to the rim of the tub, and a flange coupled to a protrusion formed at an inner surface of the front wall, wherein the coupling portion is formed to surround inner and outer surfaces of a front portion of the rim, wherein the coupling portion is coupled to the rim by a coupling ring while surrounding an outer circumferential surface of the rim and extends to a rear side of the opening of the front frame while surrounding the outer circumferential surface of the rim, wherein the coupling portion is configured to seal the front wall and the front frame, wherein the flange extends outwardly in radial direction such that the flange is seated on the inner surface of the front wall, and wherein the flange is formed with a groove to be engaged with the protrusion formed at the inner surface of the front wall of the tub.

2. The laundry machine according to claim 1, wherein the coupling portion further includes a door sealing portion, which comes into contact with the door, to seal the door.

3. The laundry machine according to claim 1, wherein the coupling portion is coupled to the tub by the coupling ring at the rear side of the opening of the front frame.

4. The laundry machine according to claim 1, wherein the flange is formed with at least one rib that protrudes rearwardly.

5. The laundry machine according to claim 4, wherein the at least one rib has a thickness that gradually decreases as the rib extends rearwardly.

6. The laundry machine according to claim 4, wherein the at least one rib includes a plurality of ribs arranged to form at least two layers.

7. The laundry machine according to claim 6, wherein at least one of the plurality of ribs extends rearwardly beyond a front end of the drum.

8. The laundry machine according to claim 6, wherein at least one of the plurality of ribs extends rearwardly of one of the plurality of ribs, which is arranged outside of the at least one rib in a radial direction.

9. The laundry machine according to claim 1, wherein the front gasket is arranged at a front side of the opening of the front frame.

10. The laundry machine according to claim 1, wherein the front wall of the tub is inclined with respect to the front frame.

11. The laundry machine according claim 10, wherein the opening of the front frame extends vertically.

12. The laundry machine according to claim 1, wherein the front frame includes a door frame portion formed to be rearwardly concave such that the door frame portion corresponds to the door, and wherein the door frame portion is fixedly coupled with the front wall of the tub.

13. The laundry machine according to claim 1, wherein the front gasket further includes a rim seated on an inner circumferential surface of the rim of the tub, and wherein the rim of the front gasket connects the coupling portion and the flange.

14. The laundry machine according to claim 1, wherein the rim is formed with a passage that guides at least one of hot air, supply water, steam, or circulating water to be introduced into the tub.

15. The laundry machine according to claim 1, further including:

a rear gasket that seals a rear portion of the tub, to prevent water from being leaked from the tub to the driver.

16. The laundry machine according to claim 1, wherein the tub is supported in a more rigid state than a state of the drum supported by the suspension.

* * * * *